United States Patent [19]

Yuh

[11] Patent Number: 4,660,660

[45] Date of Patent: Apr. 28, 1987

[54] ROUND/FLAT CARBIDE SEAT

[75] Inventor: Ching-Fen Yuh, Houston, Tex.

[73] Assignee: TRW Inc., Cleveland, Ohio

[21] Appl. No.: 735,038

[22] Filed: May 17, 1985

[51] Int. Cl.[4] ..... E21B 10/52

[52] U.S. Cl. ..... 175/410; 175/413

[58] Field of Search ..... 175/410, 413, 374; 299/91; 403/334

[56] References Cited

U.S. PATENT DOCUMENTS

| | | | |
|---|---|---|---|
| 3,389,761 | 6/1968 | Ott | 175/410 X |
| 4,047,583 | 9/1977 | Dyer | 175/410 |
| 4,150,728 | 4/1979 | Garner et al. | 175/410 X |
| 4,176,725 | 12/1979 | Shields | 175/374 |
| 4,289,211 | 9/1981 | Lumen | 175/410 |

FOREIGN PATENT DOCUMENTS

| | | | |
|---|---|---|---|
| 649816 | 2/1979 | U.S.S.R. | 175/410 |

*Primary Examiner*—James A. Leppink
*Assistant Examiner*—Matthew Smith
*Attorney, Agent, or Firm*—Kenneth G. Preston, Jr.; James W. McKee

[57] ABSTRACT

A percussion drill having a rounded and tapered contact surface conformation between the inner ends of hardened insert members closely received by cavities in a drill bit. Each insert has a radiused inner end in contacting relation with the bottom wall of its associated cavity. The radius is such that it compensates for angular deviations in the cavity bottom wall due to manufacturing tolerances from a normal relation relative to the cavity longitudinal axis. The radius of the insert inner end is calculated on the basis of a mathematical formula. The arrangement provides a structure which prevents corner load and stress, and insures contact away from the corner to thereby increase bit life.

8 Claims, 11 Drawing Figures

ROUND/FLAT CARBIDE SEAT

BACKGROUND OF THE INVENTION

This invention relates to an improved design for seating hard wearing button inserts in interfering sized cavities in percussion drill bits and will be described with particular reference thereto. It is to be appreciated, however, that the invention has broader applications and may be adapted to use in a number of other environments.

Button inserts formed from sintered carbide or other hard materials normally mounted in generally cylindrical cavities in drill bits with one end of the inserts protruding therefrom. The other or inner ends of the inserts are seated against the bottom surface of the associated cavity. During operation, a percussion tool strikes the top of the drill bit. The impact stress waves caused by this percussion travel through the drill bit to the inserts which, in turn, fracture the rock against which the drill is held. As a result of this action, considerable impact forces are generated during the drilling process.

The seating surface between each insert and the associated cavity in a drill bit is the major area for the energy transmission of these impact forces with resultant severe stress concentrations therebetween. These stress concentrations are due to the difference in elasticity between the carbide of the insert (100,000,000 psi) and the bit material (30,000,000 psi). The stress concentrations are also due to the interplay of the manufacturing tolerances for the drill bit and insert, and, eventually, failure results.

In the prior art, great concern has been focused on corner stress concentrations in, and the subsequent fatigue failures of, button insert drills. In some cases some sort of captured shape has been recommended to confine the forces, or a corner clearance has been used to minimize the magnitude of the developed corner forces. These solutions have merit as long as there is no angular manufacturing tolerance deviation between the adjoining contacting surfaces of the insert inner end and the bottom of the cavity, ie., the inner end surface of the insert and the bottom surface of the cavity meet with full planar contact. As soon as there is some sort of angular deviation between these adjoining surfaces, the surfaces will no longer meet in a plane, and the angular stress concentrations will overwhelm the proposed prior art solutions and result in numerous drill failures. Moreover, to limit this angular deviation, the manufacturing tolerances must be tightly controlled in these types of prior art devices.

The present invention overcomes the foregoing problems and others to provide a new and improved insert seat arrangement. The invention successfully compensates for any manufacturing tolerance angular deviation between the adjoining contacting surfaces and minimizes uneven stress concentrations in the drill.

BRIEF SUMMARY OF THE INVENTION

In accordance with the invention an improved design is provided for the seating surface between a button insert and an associated cavity in a drill bit to overcome problems of manufacturing tolerance angular deviations between the mating surface areas thereof.

More particularly in accordance with the invention, compensation for the manufacturing tolerance angular deviations is achieved by rounding one of the inner end surfaces of the insert and the bottom wall of the drill bit receiving cavity. The amount of curvature is such that the instantaneous slope of such rounded surface is slightly greater than the theoretical full manufacturing tolerance slope of the mating surface. With this configuration, the point of contact between the inner end surface of the insert and the bottom surface of the cavity will always occur along the arc of curvature of the rounded surface, and critical edge contact will be avoided for all manufacturing tolerance angular deviations of the mating surfaces.

According to another aspect of the invention where the inner end surface of the insert is rounded, the radius of curvature is substantially greater than the width or diameter of the insert seating surface.

In accordance with a further aspect of the invention, the insert meets the body of the drill bit in a plurality of planes of contact.

In accordance with still another aspect of the invention, the radius of curvature of the rounded surface on one of the insert inner end and cavity bottom wall is mathematically calculated on the basis of predetermined relationships.

It is a primary advantage of the subject invention to confine the contact zone between the inner end of an insert member and the receiving cavity of an associated drill bit within the arc of the seating surface under all manufacturing tolerances.

Another advantage of the invention resides in maintaining sufficient contact area between the inner end of an insert member and the associated cavity in a drill bit during normal drilling operations.

Still another advantage of the invention is found in a reduction of contact stress concentration between the inner end of the insert member and the drill bit.

Yet a further advantage of the present invention is represented by an increase in the useful life of percussion drill bits.

Other advantages and benefits of the invention will become apparent to those skilled in the art upon a reading and understanding of the following detailed specification.

BRIEF DESCRIPTION OF THE DRAWINGS

The invention may take form in certain parts and arrangements of parts, preferred and alternate embodiments of which will be described in detail in this specification and illustrated in the accompanying drawings which form a part hereof and wherein.

DETAILED DESCRIPTION OF THE PREFERRED EMBODIMENT

Figure 1:
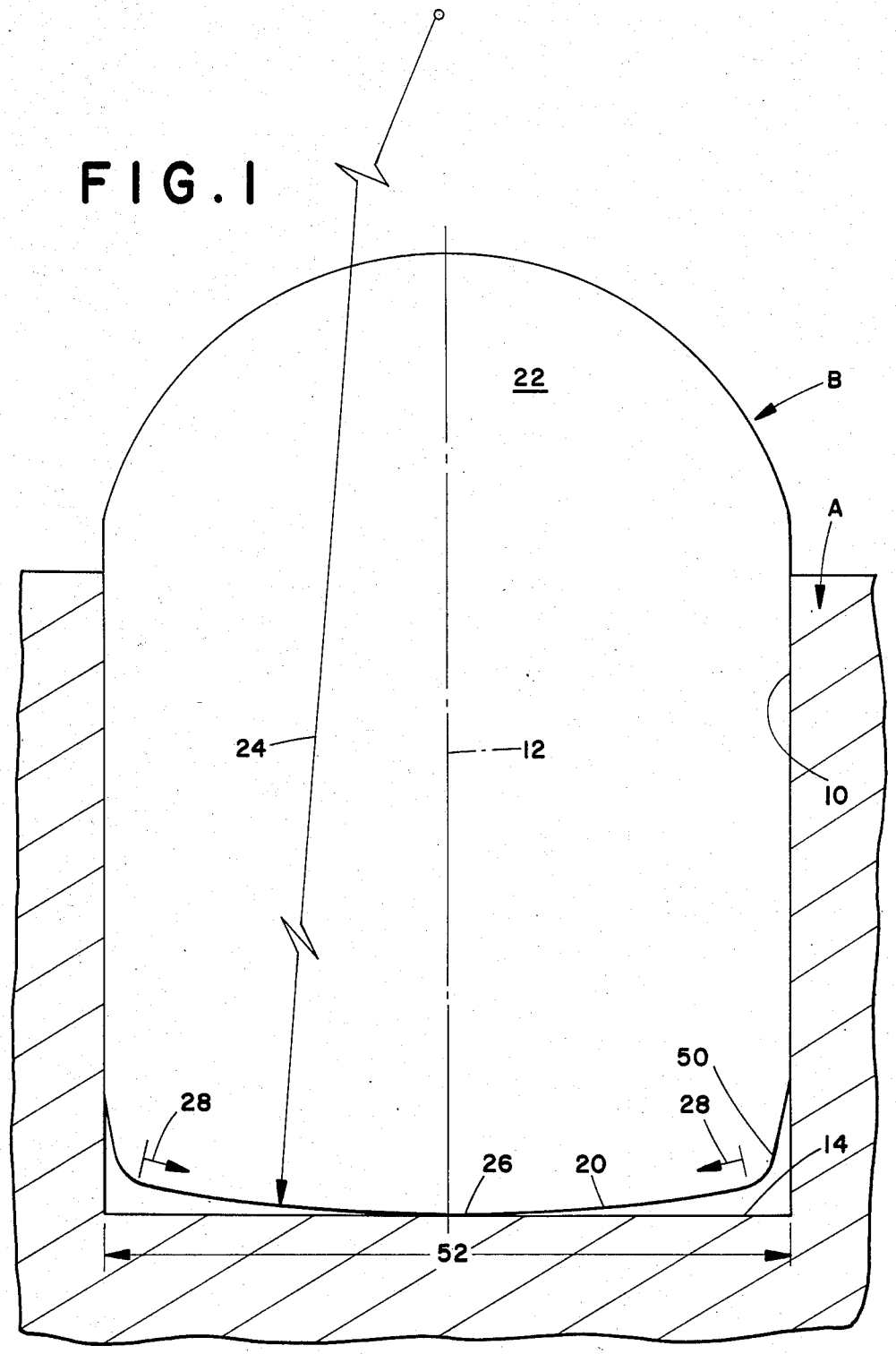
FIG. 1 is a cross-sectional view showing a portion of a drill bit having a hardened button insert fixedly mounted in an insert receiving cavity in accordance with the concepts of the subject invention.

Referring now to the drawings wherein the showings are for purposes of illustrating preferred and alternate embodiments of the invention only and not for limiting same, FIG. 1 shows a small portion of a steel drill bit A having a carbide insert B fixedly secured therein. A drill bit normally contains a plurality of these inserts disposed in a predetermined configuration or pattern. As shown, the drill bit contains a generally cylindrical cavity 10 for receiving the insert, it being appreciated that a plurality of like or similar cavities are disposed in a predetermined pattern to accommodate a plurality of like or similar inserts B. While description will hereafter be made with reference to one insert and associated receiving cavity, it will be appreciated that the arrangements for the other inserts and cavities are identical thereto unless otherwise specifically noted.

Cavity 10 is normally drilled and reamed to conform to the associated insert. A centerline 12 runs axially through the cavity, and a cavity bottom wall 14 is designed to be substantially normal to the centerline. In fact, however, due to normal manufacturing tolerances, bottom wall 14 will vary by ± a certain number of degrees "b" from the desired normal relationship.

Each insert B is substantially cylindrical, and includes an inner end 20 and an outer end 22. Both of inner and outer ends 20, 22 have rounded surfaces, although by different amounts. The insert is located within cavity 10 with insert outer end 22 protruding slightly outwardly from the drill bit surface. Inner end 20 is curved away from the central area of cavity bottom wall 14 in all directions.

The radius 24 of the insert inner end is chosen such that the contact zone 26 between the insert and cavity bottom wall 14 is confined within the arc 28 of the inner end seating surface under all normal manufacturing tolerances. Such relationship avoids critical corner contact while maintaining a sufficient energy dispersal contact area between insert B and drill bit A. The rounded shape efficiently transfers the impact forces between the insert and the drill bit under manufacturing tolerance angular deviations, while avoiding uneven contact of the type that leads to drill failure. The impact deformation of cavity bottom wall 14 occurs more or less centrally and is spread out over a smooth rounded shape. Also, the tensile forces of the insert on the steel of the drill bit are not as quick in producing fatigue cracks which eventually will render the drill unusable, thus significantly increasing the effective life of the drill bit. The rounded shape of insert inner end 20 compensates for tolerance variations from the norrmal which occur in bottom wall 14 as a result of conventional manufacturing procedures.

Figure 2:
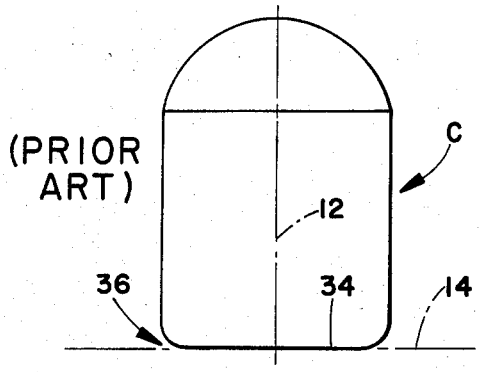
FIGS. 2–7 are generally schematic views of a series of flat and round bottom carbide button insert seating surfaces showing various manufacturing tolerance conditions.
Figure 3:
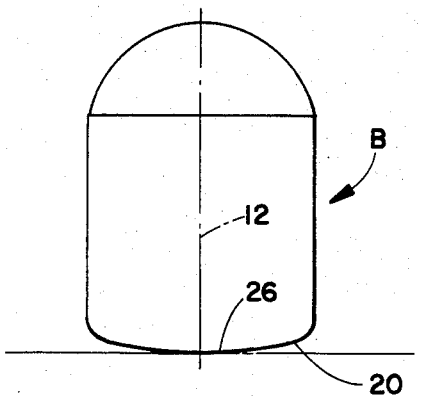
Figure 4:
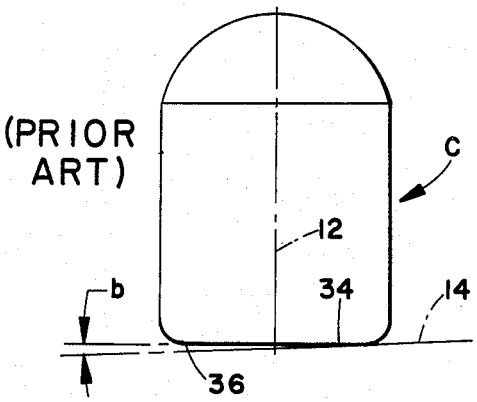
Figure 5:
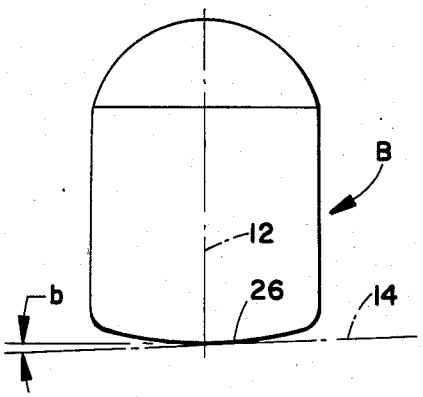
Figure 6:
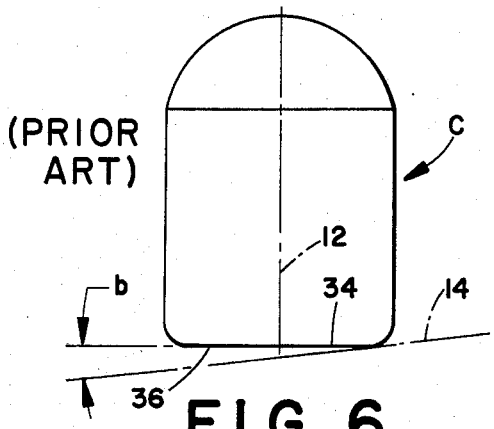
Figure 7:
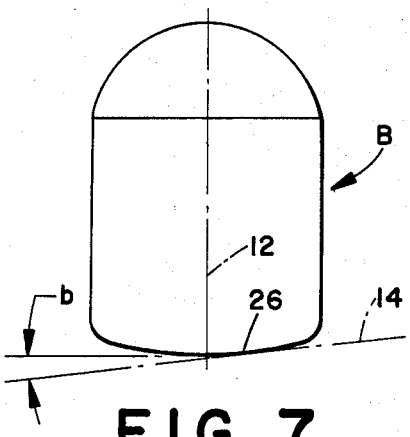

The foregoing compensation results can readily be appreciated by a comparison of FIGS. 2, 4, and 6 which show typical flat ended prior art inserts under certain bottom angle deviations with FIGS. 3, 5, and 7 which show the subject new rounded end insert under similar deviation conditions. When cavity bottom wall 14 is normal to centerline 12 of the cavity, the typical flat ended insert C has a full surface contact area 34 between the insert inner end 36 and cavity bottom wall 14 (FIG. 2). Under the same conditions, the round ended insert B of the subject invention has central contact zone or area 26 (FIG. 3). When bottom wall 14 of the cavity varies from the normal as by an angle "b" of just a few degrees due to normal manufacturing tolerances, however, flat bottomed insert C will have a very restricted corner type contact area 34 as shown in FIG. 4. As a result, the insert cavity will very quickly suffer terminal fatigue. Under identical conditions, the round ended insert B still has a central contact area 26 (FIG. 5) and restricted contact is not produced by the angular deviation between the insert and cavity contact surfaces. When bottom wall 14 of the cavity varies by the full manufacturing tolerance which equals some predetermined maximum deviation angle "b", the rounded bottom insert still avoids the critical corner contact which is present in the prior art. In this regard, the relative disposition of contact areas 34 and 26 in FIGS. 6 and 7 should be contrasted with each other.

Referring again to FIG. 1, the principal focus of the subject invention is that with ordinary manufacturing tolerances, the actual contact area 26 between inner end surface 20 of the insert and bottom wall 14 of the drill bit cavity occurs within arc 28 of radius 24. The contact area does not occur at the corner of the insert, even if bottom wall 14 deviates from a normal relationship to central axis 12 by the maximum deviation angle "b" permitted under full tolerance conditions.

Note should be taken that it is not necessary for inner end surface 20 of insert B to be shaped with a uniform radius. The shape can vary, e.g., elliptical, stepped, etc., as long as the contact area is along an arc with radius 24, ie., rounded inner end 20 has a greater relative slope than bottom wall 14 of the drill bit cavity.

Since the invention causes contact area 26 to occur near to the center of cavity bottom wall 14 under most manufacturing conditions, deformation of the bottom wall caused by the compressive forces produced by insert B can be dissipated without the localized tensile stress concentrations which are present in the prior art constructions. Specifically, deformation of bottom wall 14 does not occur at the critical corner location. Instead, this deformation occurs primarily over a resilient planar area and significantly increases the operational life of drill bit A.

Figure 11:
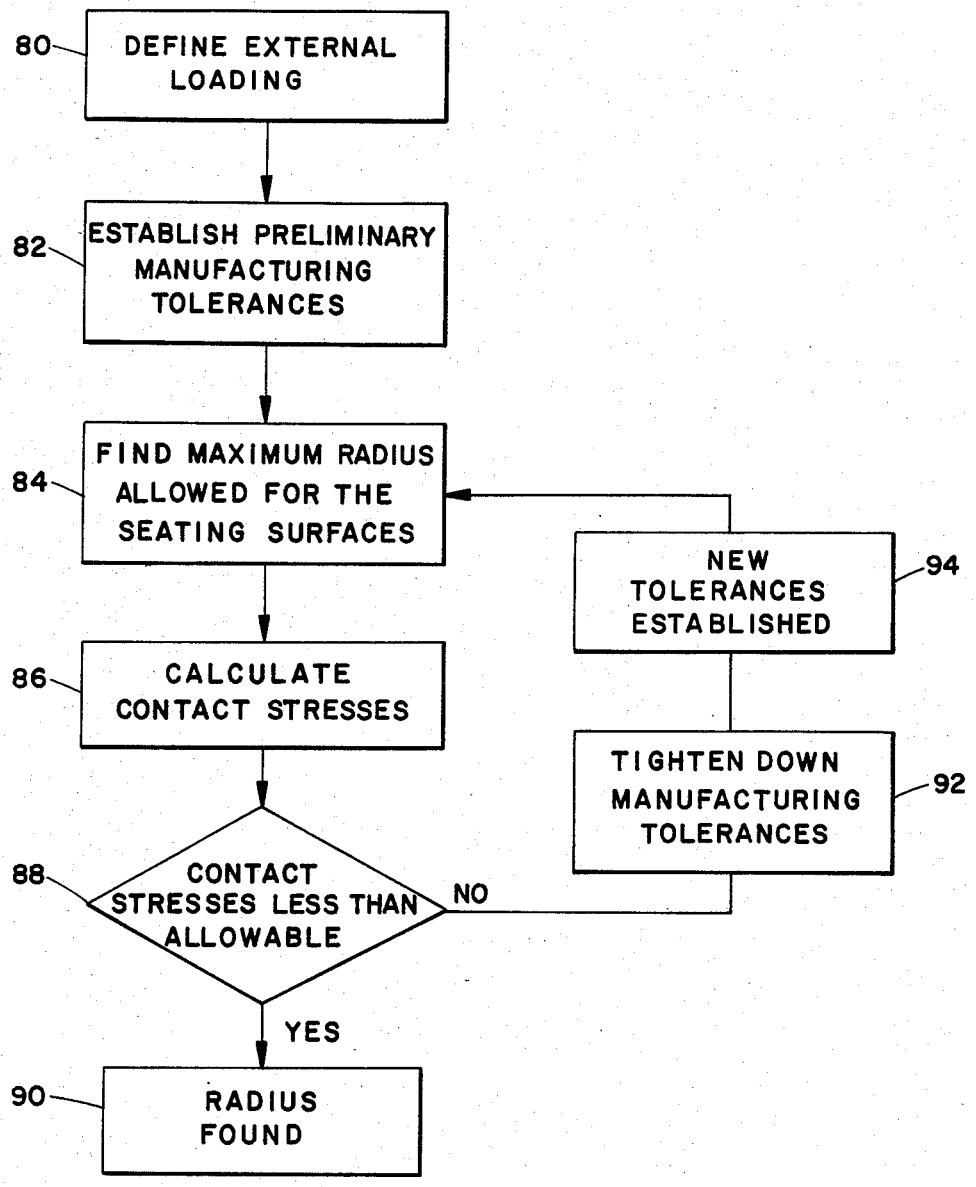

Radius 24 of insert inner end 20 is normally from about 1 to 100 times the effective width 52 of the seat of insert B, with 5 to 30 times being typical. The actual radius 24 of insert inner end 20 is, however, normally calculated by means of a particular mathematical procedure. Such procedure is schematically shown in FIG. 11. As shown, the procedure is begun at step 80 and encompasses defining the external loading that will be present on insert B. This external loading figure comprises the amount of force that will need to be transferred between the insert and drill bit A to effect the desired drilling results.

The next step is designated by numeral 82 and comprises establishing the preliminary manufacturing tolerances for cavity 10 in the drill bit. To accomplish this, width 52 of the cavity bottom wall and maximum angular deviation angle "b" which will result from manufacturing operations are calculated. The width 52 comprises the distance across the wall with which an ordinary flat shape would be placed in physical contact. Therefore, and with the single flat surface of FIG. 1, width 52 comprises the diameter of cavity 10. Angular tolerances b of the cavity bottom wall comprises the normally expected manufacturing deviations of the bottom wall from a perpendicular relationship to cavity centerline 12.

Figure 8:
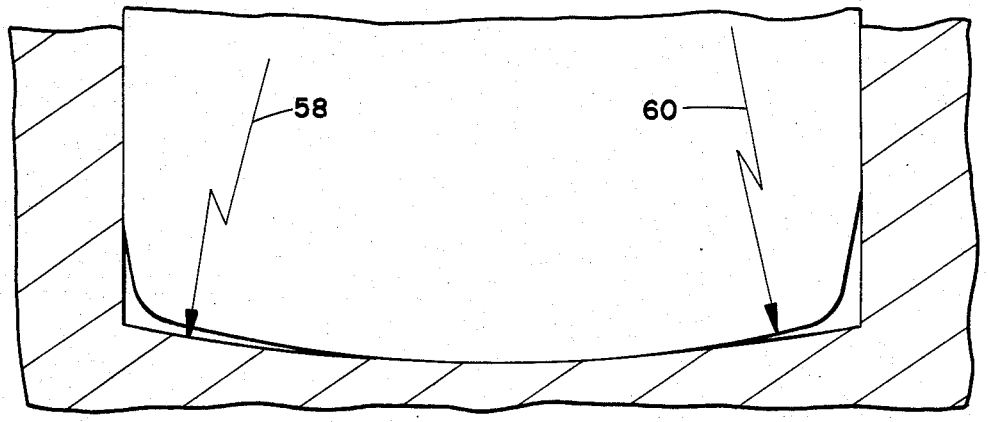
FIGS. 8–10 are fragmentary cross-sectional views of the inner ends of carbide button inserts showing alternate embodiments of the invention; and, FIG. 11 is a flow chart of a method for determining the preferred radius of the inner end of a button insert in accordance with the invention.
Figure 9:
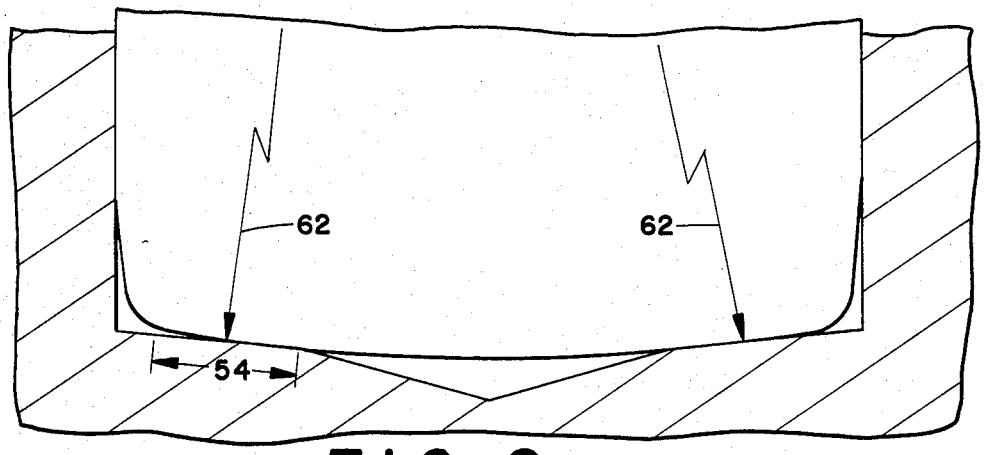
Figure 10:
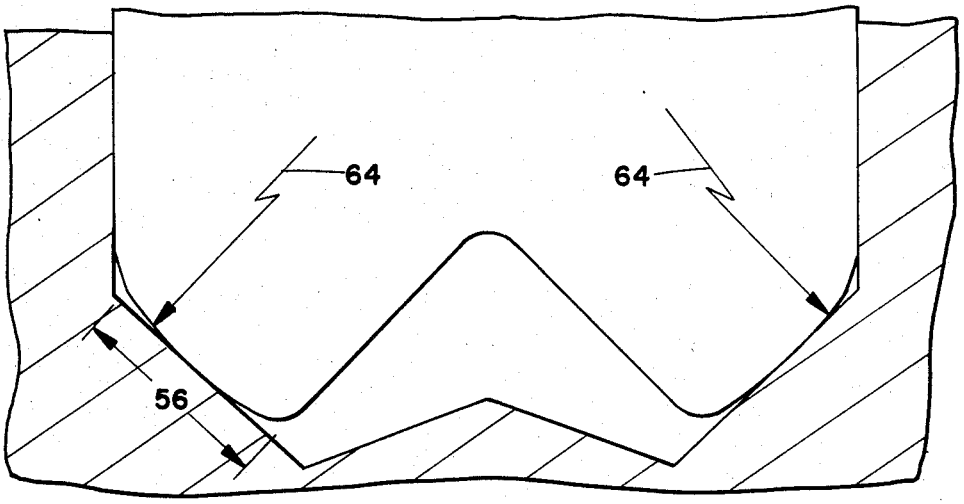

With more unusual arrangements such as the segmented, angularly displaced surfaces illustrated in FIGS. 9 and 10, the width of the cavity bottom wall comprises the distance across the contact portion thereof and are designated by numerals 54, 56, respectively. With a concave bottom surface on the insert inner end and a concave or convex cavity bottom wall as is shown in FIG. 8, a mathematical approach to determining radius 24 would ordinarily not be used. Instead, a radius 58 of the rounded cavity bottom wall would be calculated. Radius 60 of the insert inner end is then chosen to be slightly less than radius 58, ie., have a greater curvature.

Having established the manufacturing dimensions for width 52, or widths 54 and 56 (FIGS. 9 and 10), along with angular tolerance "b" of bottom wall 14 allowed by the manufacturing tolerances, step 84 in the method comprises calculating radius 24, or radii 62, 64 (FIGS. 9 and 10), of the insert inner end. Radius 24 is mathematically calculated according to the following formula:

$$\text{Radius 24} \leqq \left[\left(\frac{\frac{\text{width (52)}}{2}}{\text{Tan "}b\text{"}}\right)^2 + \left(\frac{\text{width (52)}}{2}\right)^2\right]^{\frac{1}{2}}.$$

After the radius has been calculated, and with reference again to FIG. 11, step 86 of the method involves calculating the contact stresses between insert B and drill bit A, ie., the effect of external loading on the contact produced by the calculated radius. If these contact stresses will not unduly damage drill bit A and are, therefore, acceptable (step 88), the calculated radius is, in turn, acceptable and can be safely used with drill bit A to obtain a satisfactory drill bit life (step 90).

If the contact stresses will unduly damage the drill bit (step 88), the allowable degree of angular tolerances "b" permitted during manufacture are decreased (step 92), and new tolerances are established (step 94). A new, maximum radius is then calculated in the same manner as previously described (step 84), and the contact stresses are again calculated. This procedure may be repeated until such time that the maximum calculated radius yields acceptable contact stress results.

The actual calculations for width 52 and angular tolerance "b" of bottom wall 14 are to be tempered with an awareness of the statistical mathematical probabilities of a number of variables, ie., the numbers input into the calculation would be compromised based on an awareness of the need for a reasonably priced, marketable product. Specifically, the choice of radius 24 will be a compromise between the desire to compensate for all manufacturing tolerance angular deviations (a smaller radius), and the need to spread the compressive forces of the insert on the cavity bottom wall over as wide an area as possible (a larger radius). Therefore, a radius is selected which optimizes both considerations, recognizing, of course, that wide manufacturing tolerances will lower the costs of manufacture and ease of drill bit construction.

Radius 24 of insert inner end 20 effectively eliminates the critical corner contact while at the same time compensating for any angular deviation of cavity bottom wall 14. The radius insures a sufficient contact area between the insert and the drill bit under normal operating conditions. The above-described features combine to greatly increase the effective, useful life of the bits.

Although the invention has been described with reference to preferred and alternate embodiments, modifications and alterations will occur to others upon a reading and understanding of this specification. It is intended to include all such modifications and alterations insofar as they come within the scope of the appended claims or the equivalents thereof.

Having thus described the invention, it is now claimed:

1. A drill bit construction comprising: a drill bit body having a blind cavity with a central axis and a bottom wall surface lying generally transversely of said axis and an insert closely received in said cavity with an inner end surface of said insert adapted to abut against said bottom wall surface over a limited area of said bottom wall to define an interface engagement area, one of said insert inner end surface and said cavity bottom wall surface being rounded and having an instantaneous slope at all points in said interface engagement area greater than the full manufacturing tolerance slope of the abutting points in said other surface the resultant curve compensating for any angular deviation between said insert inner end surface and said bottom wall surface.

2. The drill bit as defined in claim 1 wherein said other of said insert inner end surface and cavity bottom wall surface is substantially flat.

3. The drill bit as defined in claim 1 wherein said cavity bottom wall surface has a designed plane of contact with said insert inner end surface which is substantially normal to a longitudinal axis of said cavity, and wherein manufacturing tolerances may cause said other of insert inner end surface and said cavity bottom wall surface to vary from a substantially normal relationship with said axis by some angle b and the designed plane of contact has a width W, the radius of curvature R of said one of said insert inner end surface and said cavity bottom wall surface being generally calculated in accord with the following formula:

$$R \leqq \left[\left(\frac{W/2}{\text{Tan } b}\right)^2 + \left(\frac{W}{2}\right)\right]^{2\,\frac{1}{2}}.$$

4. A percussion drill comprising: a generally cylindrical insert having an inner end closely received in a blind cavity provided in a drill bit, said cavity having a longitudinal axis and a bottom wall surface deviating within predetermined angular limits from a normal relationship with said axis and with said insert inner end having an end surface disposed in contacting relation with said bottom wall to define an interface engagement area, said insert end surface being curved away from said cavity bottom wall surface in all radial directions and having an instantaneous slope at all points in said interface engagement area greater than the full manufacturing tolerance slope of the abutting points in said bottom wall face to compensate for any angular deviation of said bottom wall face from a normal relationship with said axis within said angular limits.

5. The percussion drill as defined in claim 4 wherein said insert inner end surface and said cavity bottom wall surface have a designed plane of contact therebetween having a width W and wherein predetermined manufacturing tolerances may cause a deviation angle b in degrees, the radius of curvature R of said insert inner end being generally calculated in accord with the following formula:

$$R \leqq \left[ \left( \frac{W/2}{\text{Tan } b} \right)^2 + \left( \frac{W}{2} \right) \right]^{2\frac{1}{2}}.$$

6. A percussion drill bit including a generally cylindrical insert having a longitudinal axis and terminating at an inner end surface said insert being received by a cavity in a drill bit wherein said cavity has a central axis and a bottom wall surface disposed in engaging relation with said insert inner end surface, said insert inner end surface being uniformly curved into a single radius surface about said insert longitudinal axis with said single radius being such that the instantaneous slope of each point on each single radius of the inner end surface is greater than the full manufacturing tolerance slope of the engaging point on the bottom wall surface.

7. The percussion drill bit as defined in claim 6 wherein said insert inner end surface and said cavity bottom wall surface have a designed plane of contact of a width W disposed generally normal to said cavity central axis and wherein predetermined manufacturing tolerances may cause said bottom wall surface to vary from a normal relationship to said central axis by some angle b, said single radius R being generally calculated in accord with the formula:

$$R \leqq \left[ \left( \frac{W/2}{\text{Tan } b} \right)^2 + \left( \frac{W}{2} \right) \right]^{2\frac{1}{2}}.$$

8. The percussion drill bit as defined in claim 7 wherein said insert tapers outwardly over the axial extent thereof from said insert inner end.

* * * * *